United States Patent [19]

Suzuki et al.

[11] 3,973,965

[45] Aug. 10, 1976

[54] MAKING SHADOW MASK WITH SLIT-SHAPED APERTURES FOR CRT

[75] Inventors: Takeshi Suzuki; Hiroshi Tanaka; Makoto Kudo, all of Fukaya, Japan

[73] Assignee: Tokyo Shibaura Electric Co., Ltd., Kawasaki, Japan

[22] Filed: May 5, 1975

[21] Appl. No.: 574,638

Related U.S. Application Data

[63] Continuation of Ser. No. 364,255, May 29, 1973, Pat. No. 3,882,347.

[30] Foreign Application Priority Data

May 30, 1972 Japan ..... 47-53034
Aug. 21, 1972 Japan ..... 47-82832
Aug. 22, 1972 Japan ..... 47-83711

[52] U.S. Cl. ..... 96/36.1; 96/36; 29/25.17; 156/8; 313/403; 313/408

[51] Int. Cl.[2] ..... G03C 5/00

[58] Field of Search ..... 96/36, 36.1; 29/25.17; 156/8; 313/403, 408

[56] References Cited

UNITED STATES PATENTS

| | | | |
|---|---|---|---|
| 3,423,261 | 1/1969 | Frantzen | 96/36.1 UX |
| 3,574,013 | 4/1971 | Frantzen | 156/8 |
| 3,652,895 | 3/1972 | Tsuneta et al. | 96/36.1 X |
| 3,669,771 | 6/1972 | Lerner | 156/8 |
| 3,844,005 | 10/1974 | Yamada et al. | 29/25.17 |
| 3,882,347 | 5/1975 | Suzuki et al. | 313/403 |

*Primary Examiner*—Edward C. Kimlin
*Attorney, Agent, or Firm*—Schuyler, Birch, Swindler, McKie & Beckett

[57] ABSTRACT

A color cathode ray tube provided with a fluorescent screen formed on the inner surface of the face plate of the envelope and comprising a plurality of stripes of phosphor elements, and a shadow mask formed with a plurality of slit apertures corresponding to the stripes of the phosphor element. Said slit apertures are spaced apart by transverse bridge members. Each slit aperture is surrounded by inclined side walls, and the cross-section of each transverse bridge along the longitudinal axis of the slit aperture takes a form of a hexagon having two lateral rising edge portions positioned at about the middle of the thickness of the shadow mask.

2 Claims, 16 Drawing Figures

PRIOR ART FIG. 1A
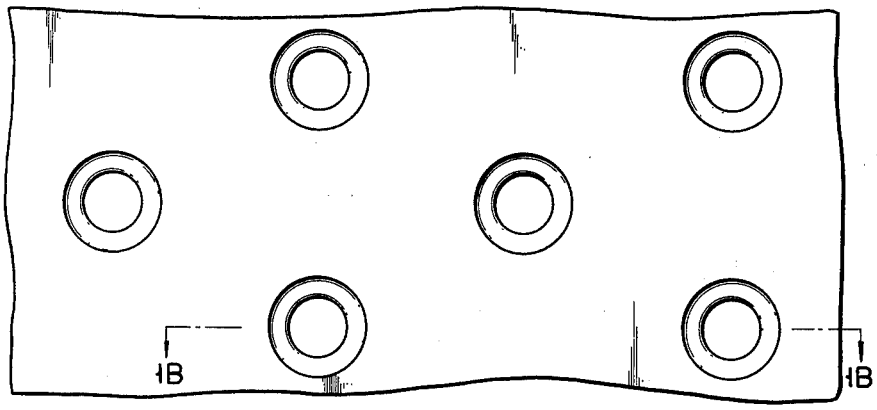
PRIOR ART FIG. 1B
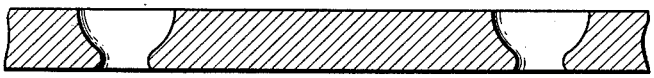
FIG. 2A FIG. 2C
PRIOR ART
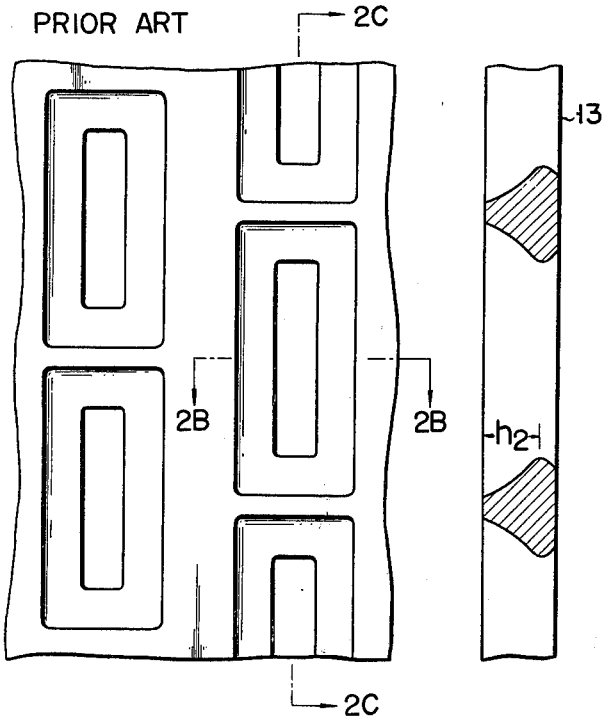
FIG. 2B
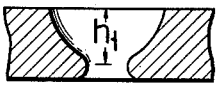

MAKING SHADOW MASK WITH SLIT-SHAPED APERTURES FOR CRT

This is a continuation of application Ser. No. 364,255, filed May 29, 1973, now U.S. Pat. No. 3,882,347.

This invention relates to a shadow mask type colour cathode ray tube and more particularly to a colour cathode ray tube having a slotted shadow mask improved beam permeability and high mechanical strength.

A prior art shadow mask type colour cathode ray tube comprises a fluorescent screen formed with a plurality of trios of three colour elemental phosphor dots respectively emanating lights of red, green and blue colours, and a shadow mask arranged to oppose the fluorescent screen and provided with a plurality of circular perforations as shown in FIG. 1A. As shown in FIG. 1B, the cross-sectional configuration of each perforation takes the form of a funnel with its opening faced to the fluorescent screen enlarged. The reason of this configuration of the mask aperture is to prevent deterioration of the colour purity which is caused by an electron beam obliquely impinging upon the side wall of the aperture, such electron beam being reflected by the side wall of the aperture and the reflected beam impinging upon an undesired phosphor dot.

There has recently been developed a so-called slit type shadow mask in which a plurality of spaced apart rectangular slots or slits are formed, with vertically adjacent slits spaced apart by transverse bridge members. It is recognized that a colour cathode ray tube provided with such a slit type shadow mask has higher brightness, contrast and colour purity than a colour cathode ray tube provided with the conventional circular perforation type shadow mask.

In the vertical slit type shadow mask, as the width of the bridge element between vertically adjacent slits is decreased, the brightness of the cathode ray tube is increased. Moreover, it is possible to alleviate moire phenomenon which is caused by the interference of the bridges with the scanning line of the electron beam, thereby improving the characteristic of the cathode ray tube. For this reason, it is desirable to decrease the vertical width of the bridge member. However, when the bridge width is decreased excessively, as the shadow mask provided with slits is formed into a spherical contour, mechanical stresses are concentrated at the bridge portions with the result that the bridges are often severed.

The reason for forming the shadow mask into a spherical contour is as follows. Usually, the electron beams are deflected in the horizontal and vertical directions to scan the fluorescent screen through the apertures of the shadow mask. In order to provide the best colour purity, the central portion and the peripheral portion of the shadow mask should be equally distant from a beam outlet of the electrode gun assembly. For this reason, the shadow mask is shaped into a spherical contour.

All side wall portions of the slit apertures of the conventional slit type shadow mask are tapered with substantially the same inclination as the circular perforations of the circular perforation type shadow mask as shown in FIGS. 1A and 1B. The prior art slit aperture was constructed such that $h_1$ is equal to $h_2$, where $h_1$ and $h_2$ represent respectively a distance between the front surface of the shadow mask which faces the fluorescent screen and the throat of the slit as defined by the side walls as viewed on the cross section of the slit aperture in FIG. 2B and as viewed on the longitudinal cross section of the slit aperture in FIG. 2C, and accordingly the throat of the slit side wall are positioned closer to the rear surface of the shadow mask.

Such a prior art slit type shadow mask is made by the following photographic process by a first negative pattern 15 and a second negative film pattern 17 which have the same configuration as the large and small openings. The photosensitive resin films applied onto the opposite surfaces of a mask substrate are exposed by light and then the opposite surfaces of the mask substrate are etched. Each of the slits of the shadow mask prepared in this manner has larger length and width than the dot patterns 14 and 16 of the first and second negative films, so that when the mask substrate is etched, owing to side etching, the width of a bridge on the front side becomes much smaller than the width of the bridge at the throat of the slit. Consequently, the bridge can not withstand the mechanical stress applied thereto at the time of forming the shadow mask into a spherical configuration, thus causing cracks in the shadow mask.

It is, therefore, an object of this invention to improve a shadow mask, particularly its bridges, thereby providing a colour cathode ray tube provided with an improved slit type shadow mask having bridges of reduced width and yet having sufficiently large mechanical strength.

Another object of this invention is to provide a colour cathode ray tube having an improved shadow mask which can increase the percentage of transmission of the electron beam, thereby increasing the brightness of the reproduced picture.

Still another object of this invention is to provide an improved colour cathode ray tube in which moire effect caused by the interference between the shadows of the bridge members projected upon the fluorescent screen and the scanning line of the electron beam can be greatly reduced thereby improving the colour purity of the reproduced picture.

According to this invention these and other objects can be accomplished by providing a colour cathode ray tube of the type comprising an envelope having a face plate, a fluorescent screen formed on the inner surface of the face plate and including a plurality of stripes of phosphor elements, and a shadow mask provided with a multiplicity of vertically elongated slit apertures and disposed in a spaced relation with respect to the fluorescent screen, characterized in that each of the slit apertures of the shadow mask is surrounded by inclined side walls which define a relatively large opening on one side of the shadow mask confronting the fluorescent screen, that the slit apertures are arranged with a predetermined relationship with respect to the stripes of phosphor elements, that each slit is vertically spaced apart by transverse bridge members, that, in the cross-section of each bridge member taken along the longitudinal axis of the slit is in a configuration in which lateral projections are formed at substantially the middle of the thickness of the shadow mask.

This invention can be more fully understood from the following detailed description when taken in connection with reference to the accompanying drawings, in which:

FIG. 1A is a plan view of a portion of a conventional shadow mask provided with circular perforations;

FIG. 1B is a sectional view of the shadow mask shown in FIG. 1A taken along a line 1B—1B;

FIG. 2A is a plan view of a portion of a conventional slit type shadow mask;

FIG. 2B shows a section of the shadow mask shown in FIG. 2A taken along a line 2B—2B;

FIG. 2C shows a section of the shadow mask shown in FIG. 2A taken along a line 2C—2C;

Figure 3:
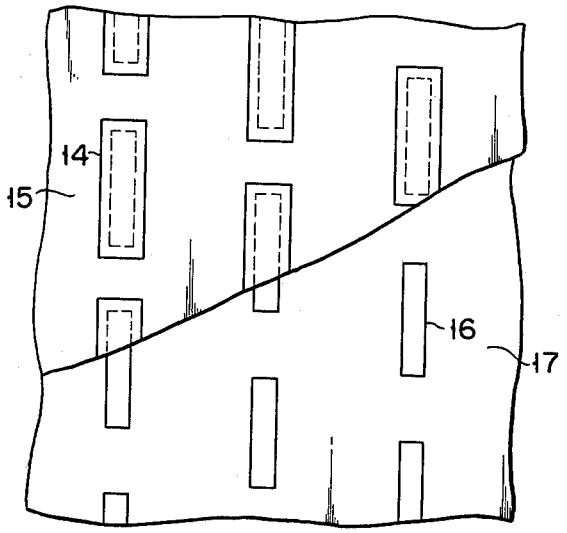
FIG. 3 shows a plan view of a portion of negative films utilized to manufacture prior art slit type shadow masks.
Figure 4:
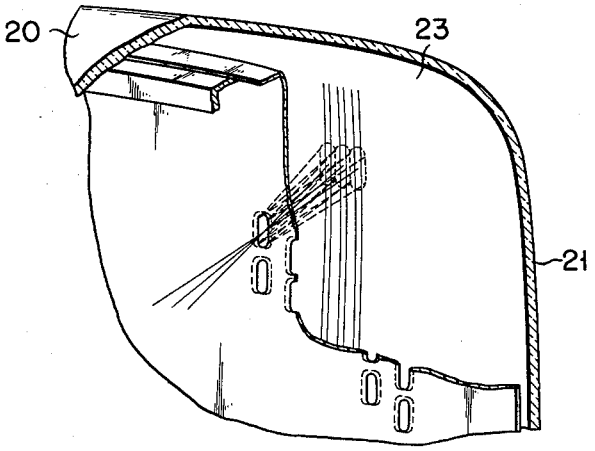
FIG. 4 shows a perspective view of a portion of a colour cathode ray tube.

Referring now to FIG. 4 of the accompanying drawings there are shown a portion of a funnel shaped envelope 20, a face plate 21 and a fluorescent screen 23 formed on the inner surface of the face plate 21. The fluorescent screen 23 is provided with a plurality of trios of stripe phosphor elements adapted to emanate three colours of red, green and blue respectively and with a plurality of light absorbing elements. Each of the elements may be a continuous or vertical stripe. As is well known in the art, the space between adjacent stripes may be coated by a substance which absorbs light. The electron gun assembly may be a delta type or an in-line type.

Figure 5A:
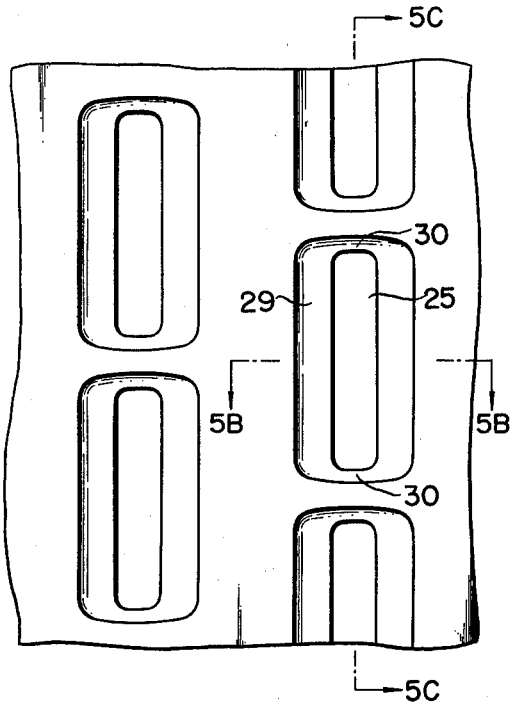
FIG. 5A is a plan view showing a portion of a slit type shadow mask embodying the invention.

The shadow mask 24 which is disposed close to the fluorescent screen 23 is made of a thin steel sheet having a thickness of about from 0.1 to 0.2 mm and is formed with a plurality of rectangular slit apertures 25 as shown in FIG. 5A. The slits 25 are disposed to correspond to respective trios of the three colour phosphor elements of the screen and each slit is vertically spaced apart by transverse bridge members 26.

Figure 5C:
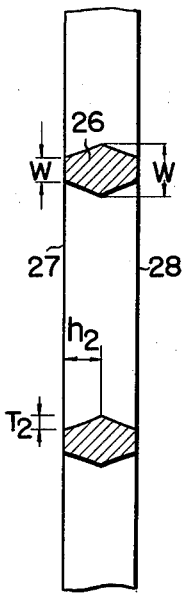
FIG. 5C shows a section of the shadow mask shown in FIG. 5A taken along a line 5C—5C.
Figure 5B:
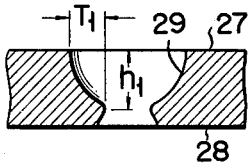
FIG. 5B shows a section of the shadow mask shown in FIG. 5A taken along a line 5B—5B.

As shown in FIG. 5B, the transverse section of each slit generally takes the form of a bowl. That is, the opening of the slit on one side 27 of the shadow mask 24 confronting the fluorescent screen is substantially larger than that on the opposite side 28, and a throat of minimum diameter is located closer to the smaller opening. The longitudinal section of the slits is shown in FIG. 5C. As shown, the throat or minimum length of the side wall is positioned at the middle of the thickness of the shadow mask and the openings on the opposite side surfaces 27 and 28 have substantially the same size. In other words, the cross-sectional configuration of each bridge member is hexagonal and the width of the bridge member is the largest at the middle of the thickness and the width decreases gradually toward opposite surfaces. Thus, the distance $h_1$ between one side surface 27 and the throat in the lateral cross-section of the slit is larger than the distance $h_2$ between the same side surface 27 and the longitudinal cross-section. The inclination angle $T_1/h_2$ of the longitudinal side walls 29 of the slit is larger than that of the lateral side wall 30, the inclination thereof being the largest at the longitudinal center of the slit and gradually decreasing toward side walls 29. On the other hand the inclination angle of the side walls 29 is substantially constant along the length thereof.

One method of manufacturing the shadow mask described hereinabove is as follows:

A pair of negative films 31 and 32 (see FIG. 6) having respectively the different rectangular patterns are prepared. The first negative film 31 is formed with rectangular dot patterns 33 so as to have a shorter length $Nl_1$ and a smaller width $Nd_1$ than the opening on the front surface 27. The second negative film 32 is formed with rectangular dot patterns 34 so as to have a larger length $Nl_2$ than $Nl_1$ and a smaller width $Nd_2$ than $Nd_1$, the rectangular dot patterns 34 being arranged to correspond to the rectangular dot patterns 33 of the first negative film 31. One example of the length $Nl$ and width $Nd$ of the dot patterns of the pair of negative films 31 and 32 is as follows.

| | nl(mm) | Nd(mm) | f(mm) |
|---|---|---|---|
| first negative film | 0.6 | 0.35 | 0.13 |
| second negative film | 0.63 | 0.03 | 0.10 |

where $f$ represents the spacing between dot patterns measured in the longitudinal direction.

As can be noted from this table these pair of negative films are characterized in that a relation $(Nl_2—nl_1)<(Nd_1—Nd_2)$ holds. As will be discussed later, this feature makes easy manufacture of a shadow mask in which the throat in the longitudinal section lies at substantially the middle of the thickness of the shadow mask.

Figure 6:
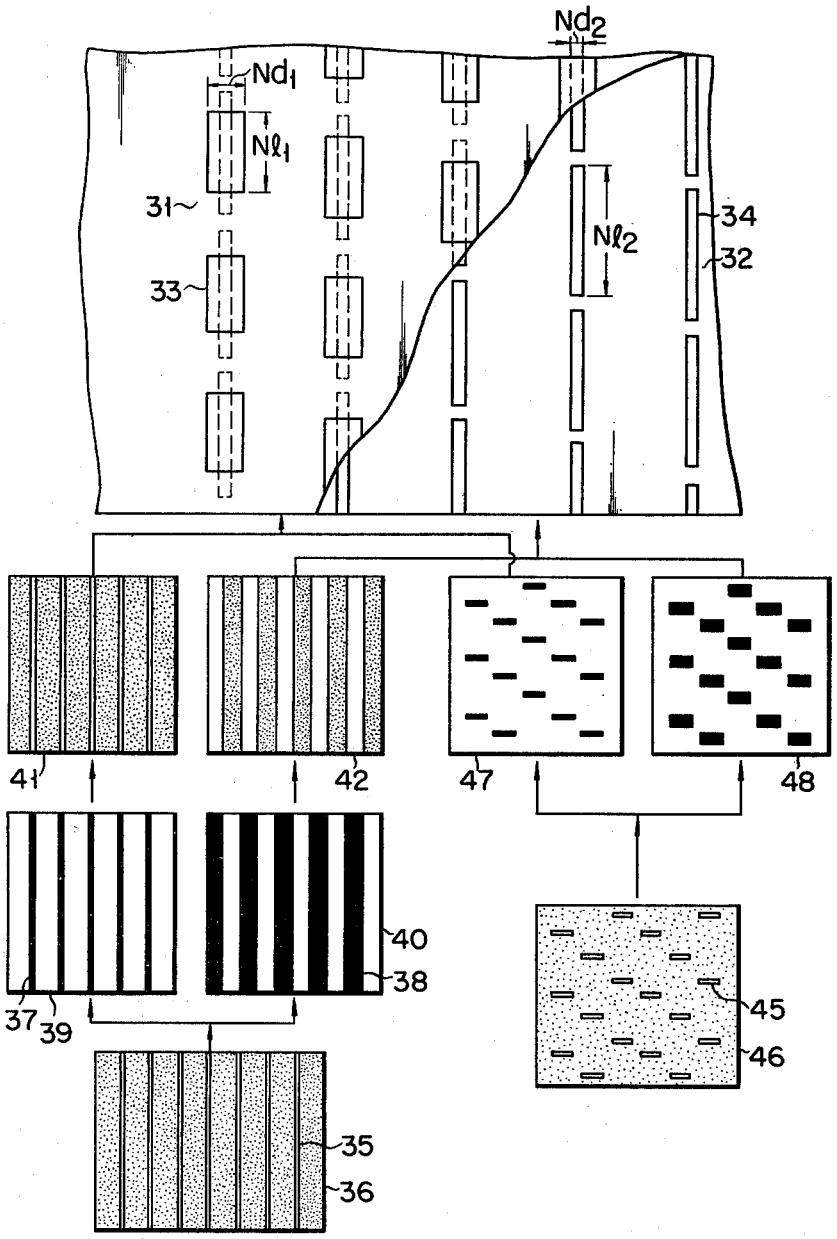
FIG. 6 is a flow chart showing the successive process steps of manufacturing the shadow mask for use in colour cathode ray tubes.

To prepare the pair of negative films 31 and 32 an original screen 36 shown at the bottom of FIG. 6 and comprising an opaque substrate formed with a plurality of parallel transparent lines 35 each having a width of about 50 microns is made by photographical technology to prepare a pair of screens 39 and 40 respectively having opaque lines 37 and 38 having widths of about 30 microns and 350 microns respectively. Then these patterns are inverted to a pair of secondary screens 41 and 42. Furthermore an opaque bridge screen 46 provided with a plurality of horizontal parallel dotted lines 45 is photographed to form a pair of bridge screens 47 and 48. Then, the bridge screens 47 and 48 are superposed upon the screens 41 and 42 with their groups of lines intersected each other at right angles to make the negative films 31 and 32. Arrows in FIG. 6 depict the successive steps of preparing negative films 31 and 32.

Figure 7A:
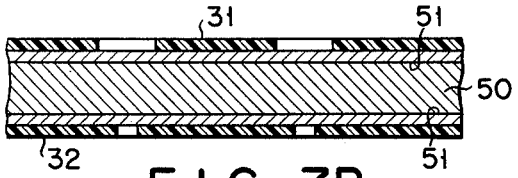
FIGS. 7A and 7B are sectional views showing the steps of manufacturing the shadow mask, the former showing a sectional view taken along the length of the slits and the latter a sectional view taken along the width of the slits.
Figure 7B:
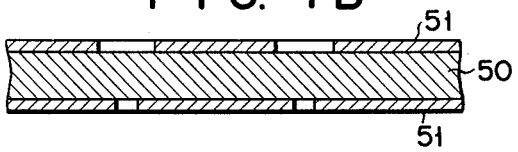

To prepare a shadow mask, photosensitive resin films 51 are applied onto the opposite surfaces of a mask substrate 50 (in this embodiment, a steel sheet), as shown in FIG. 7A. The first and second negative films 31 and 32 are disposed in contact with the opposite surfaces of the mask substrate coated with the photosensitive resin. By exposing to light, the dot patterns of the negative films 31 and 32 are respectively printed on the photosensitive resin films 51 on both sides. Then, as shown in FIG. 7B, portions of the films not exposed to light are removed to partially expose the surface of the mask substrate 50. The configurations and areas of the exposed surface correspond to those of the dot patterns 33 and 34 of the negative films 31 and 32.

The mask substrate 50 is treated for improving the corrosion resistant property and the bonding force to the surface of the substrate of the films 51 of the photosensitive resin, and then the opposite surfaces of the substrate 50 are etched.

The etching process starts from the opposite exposed surfaces of the substrate and after a certain period slit apertures 25 are formed through the substrate 50. The etching proceeds not only in the direction of the thickness of the substrate 50 but also in the lateral direction so called side-etching. Accordingly, inclined side walls 29 and 30 are formed and slits are formed to have larger rectangular configurations than the rectangular dot patterns 33 and 34 of the first and second negative films 31 and 32.

Figure 8A:
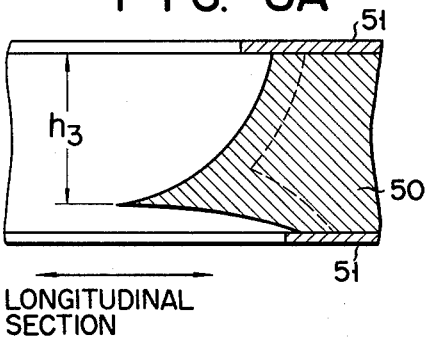
FIGS. 8A and 8B show longitudinal and transverse sections of a slit during etching.
Figure 8B:
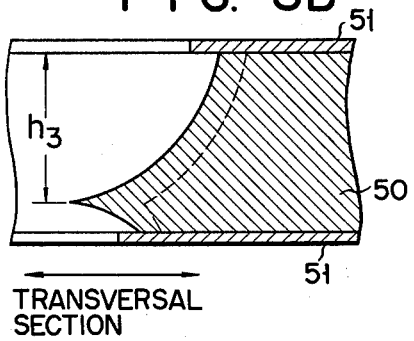

The manner of forming the perforations or slits will be considered in more detail. Since the exposed area on one side on which the dot pattern images of the first negative film have been formed is larger than the exposed area on the other side on which the dot pattern images of the second negative film 32 are formed, unless the etching condition on both sides are not extremely unbalanced, the etching from one side proceeds at a higher speed than that from the other sides so that the meeting point of both openings will be located closer to the other side. At the moment when the juncture is formed, the distance $h_3$ between said one side and the juncture is the same both in the longitudinal and transverse sections as shown in FIGS. 8A and 8B. But doe to the difference in the size and configuration of the dot patterns 33 and 34 of the first and second negative films 31 and 32, the side walls of the etched perforations are formed at different inclination angles, and within a very short time interval after forming the juncture formed two perforations which have been formed the position of the throat in the transverse section or the distance between said one side and the throat of the ultimately obtained slit 25, will not vary appreciably as shown by dotted lines in FIG. 8B. However, the position of the throat in the longitudinal section will move to substantially the middle point of the thickness of the shadow mask as shown in FIG. 8A.

After forming the slits, the photosensitive resin films 51 remaining on the surface of the substrate are removed and the substrate is completed as a shadow mask.

Figure 9:
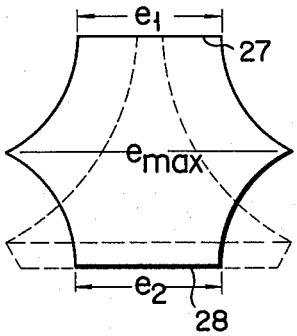
FIG. 9 shows the cross-section of a bridge member in which solid lines show the cross-section of a bridge member embodying the invention and dotted lines that of a prior art bridge member.

The shadow mask of this invention has following advantages over the prior art shadow mask. As above described, in the shadow mask, since the throat of the slit in the longitudinal section is located at substantially the middle of the thickness of the shadow mask, as diagrammatically shown in FIG. 9, the widths $e_1$ and $e_2$ of the bridge member on both sides 27 and 28 are nearly equal so that it is possible to minimize the differences between the maximum bridge with $e_{max}$ at the throat and the bridge widths $e_1$ and $e_2$ on both sides, that is $e_{max}$-$e_1$ or $e_{max}$-$e_2$. For this reason, it is possible to invert the cross-sectional area of the bridge member from that of the prior art bridge member shown by dotted lines in which the throat of the slit is located closer to one side of the shadow mask so that the bridge width on the opposite side becomes too narrow. This construction imparts a sufficiently large mechanical strength to the shadow mask to withstand the mechanical stress caused by the shaping into a spherical configuration. This improved construction also enables reduction of the width of the bridge member and hence an increase in the effective area of the slits and an increase in the percentage of transmission of the electron beam thereby reproducing a brighter picture. Decrease of the width of the bridge member also decreases the moire effect caused by the interference between the bridge shadow and the scanning line of the electron beam, thereby providng the quality of the colour picture tube.

With the improved shadow mask, since the throats of the slit is located at different positions in the longitudinal and transversal sections it is possible to decrease the radius of curvature at the corners of the perforations as compared to in the prior art shadow mask. This means that it is also possible to increase the percentage of transmission of the electron beam whereby the brightness of the reproduced picture is increased.

In manufacturing a colour picture tube having a light absorbing stripe type fluorescent screen in which the spaces between narrow stripes of phosphors are coated with light absorbing substance, after forming the fluorescent screen the slits of the shadow mask are usually enlarged by etching in the prior art shadow mask the bridge portion on one side being smaller (see FIG. 9) is etched more severely than the bridge portion on the opposite side whereby the mechanical strength of the shadow mask is greatly decreased. However, according to this invention, since there is no such portion of the bridge member having an extremely narrow width and there is no local portion where etching proceeds too fast, a shadow mask has proper characteristics and is suitable for use in the light absorbing stripe type colour picture tubes.

Furthermore, in the shadow mask since the longitudinal side walls of the slits are formed with the same or larger angle of inclination as the prior art design there is no problem. As the inclination angle of the transverse side walls is smaller than that of the longitudinal side walls, too small inclination angle of the transverse side walls would result in the reflection of the impinging electron beam toward the fluorescent screen as well as in the secondary electron emission. However, since the area of the transverse side walls is smaller than that of the longitudinal side walls there is no disadvantage of the colour picture tube utilizing such shadow mask.

What we claim is:

1. A method of preparing a shadow mask for a cathode ray tube, said shadow mask being provided with a multiplicity of vertically elongated slit apertures and disposed in spaced relationship with respect to said fluorescent screen, said slit apertures being vertically spaced apart by transverse bridge elements, each of said slit apertures having a first pair of vertical side walls and a second pair of lateral side walls for defining the throat of said slit aperture, said throat being the most constricted opening defined by said aperture, said second pair of side walls defining said transverse bridge elements, each of said side walls comprising a portion inclined with respect to the surface of said mask facing said fluorescent screen and terminating at said throat, said inclined portions of said lateral side walls being so inclined as to locate the lateral portion of said throat substantially at the center of the thickness of said shadow mask between the surface of said mask facing said fluorescent screen and the surface thereof facing said guns at a longitudinal section along the longitudinal central axis of each of said slit apertures of said mask, said inclined portions of said vertical side walls being inclined to locate the vertical portion of said throat substantially closer than said lateral portion of the throat to said surface of said mask facing said guns, comprising the steps of:

applying a film comprising a photosensitive resin onto first and second surfaces of a mask substrate to be used to form said shadow mask, printing first and second dot patterns on the films on said first and second surfaces, the dots on said first and second patterns having rectangular configurations and overlying one another, the dot pattern rectangles of said first surface exposing a larger area than the dot pattern rectangles of said second surface, etching through said mask substrate according to said dot pattern from both surfaces at a rate not substantially unbalanced to define said apertures and said throat in each of said apertures, said first surface of said mask substrate comprising the surface facing said screen, and said second surface facing said guns.

2. The method of claim 1 wherein the rectangles of said dot patterns of said second surface are both narrower and longer in the longitudinal direction of said mask than the corresponding rectangles of said first dot pattern.

* * * * *